US006693391B2

(12) United States Patent
Ahroni

(10) Patent No.: US 6,693,391 B2
(45) Date of Patent: Feb. 17, 2004

(54) DECORATIVE LIGHTING APPARATUS

(76) Inventor: Joseph M. Ahroni, 6554 5th Pl. South, Seattle, WA (US) 98108

( * ) Notice: Subject to any disclaimer, the term of this patent is extended or adjusted under 35 U.S.C. 154(b) by 0 days.

(21) Appl. No.: 10/072,812

(22) Filed: Feb. 8, 2002

(65) Prior Publication Data

US 2003/0151368 A1 Aug. 14, 2003

(51) Int. Cl.[7] ..... H05B 37/00; F21S 13/14
(52) U.S. Cl. ..... 315/185 R; 362/252
(58) Field of Search ..... 315/185 R, 185 S, 315/192; 362/249, 252, 253, 391, 806

(56) References Cited

U.S. PATENT DOCUMENTS 5,109,324 A * 4/1992 Ahroni ..... 362/249
5,513,081 A * 4/1996 Byers ..... 362/145
6,074,244 A * 6/2000 Crum et al. ..... 439/505
6,155,697 A * 12/2000 Ahroni ..... 362/252
6,439,740 B1 * 8/2002 Yan ..... 362/216
6,478,455 B2 * 11/2002 Ahroni ..... 362/352
6,488,386 B1 * 12/2002 Yan ..... 362/216

* cited by examiner

*Primary Examiner*—Don Wong
*Assistant Examiner*—Minh Dieu A
(74) *Attorney, Agent, or Firm*—Seed IP Law Group PLLC

(57) ABSTRACT

A lighting fixture and a method of fabricating the same are shown and described herein in one particular embodiment, a light fixture comprises a plurality of vanes projecting radially outward from a central core, and a series of lights coupled to the fixture. The vanes can each be semi-circular, and can each be identical in size, such that the fixture as a whole is generally spherical. In addition, a method of fabricating a light fixture by bending an elongated structure alternatingly in opposite directions to form such a plurality of vanes is shown and described.

26 Claims, 7 Drawing Sheets

DECORATIVE LIGHTING APPARATUS

BACKGROUND OF THE INVENTION

1. Field of the Invention

The present invention relates to decorative lighting apparatus of the type in which a string of lights is mounted on one or more support frames to achieve a predetermined lighting design, and to methods of fabricating the same.

2. Description of the Related Art

Traditionally, strings of lights have been hung from eaves on houses and from other structures to decorate the structure and/or to illuminate the area surrounding the structure. Most commonly, such strings of lights have been hung during the holiday season. Typically, these strings of lights contain a series of spaced apart light bulbs of one or a variety of colors.

Wire frames have been developed for holding strings of lights and for forming the lights along an outline of an object such as a Christmas tree. Similarly, solid frames have been made, such as from plywood, and in any number of shapes and sizes.

BRIEF SUMMARY OF THE INVENTION

The present invention is directed toward lighting fixtures that can be attached alone or with other lighting fixtures to an electrical cord or a string of lights. One particular embodiment of the present invention comprises a plurality of vane structures projecting radially outward from a central core, and a light coupled to each vane. The vane structures can be of a semi-circular shape and can be of the same size such that the fixture has an overall shape generally appearing as a sphere. A fixture can also be formed from a single unitary structure that has been folded in altematingly opposite directions to create the vanes and the radial spaces between the vanes.

In another embodiment, the present invention is directed toward a fixture fabricated from a series of linked rings. Each ring has a central hinge and is connected to any adjacent ring by a tangential hinge generally parallel to the central hinge. The central hinges are folded in a first direction and the tangential hinges are folded in an opposing second direction to form a light fixture having a number of radially spaced apart vanes. A string of lights is mounted to the fixture.

The present invention is also directed toward a method of fabricating a light fixture by alternatingly folding an elongated structure in opposing directions, then coupling a series of lights to the structure.

DETAILED DESCRIPTION OF THE INVENTION

Figure 1:
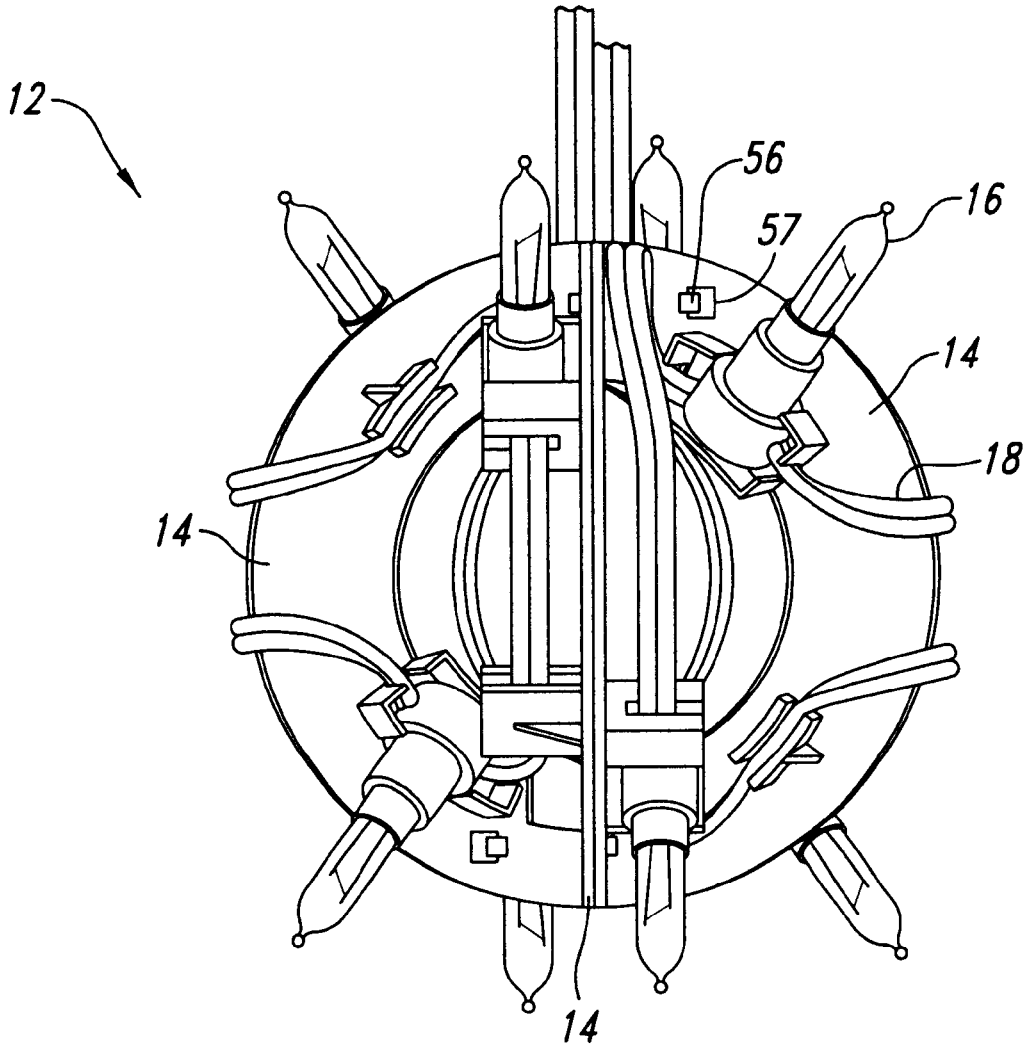
FIG. 1 is an elevation view of a light fixture and a series of lights according to one embodiment of the present invention.

Referring to the drawings it is seen that one embodiment of the present invention takes the form of a lighted ball-shaped plastic frame 12 having multiple two-plied semi-circular vanes 14 radiating relative to a center axis. The vanes 14 are separated by equal acute dihedral angles a (FIG. 11) within each of which a pair of light units 16 is mounted, one on each vane forming the dihedral angle. An electric cord 18 connects the light units 16 in series.

Figure 2:
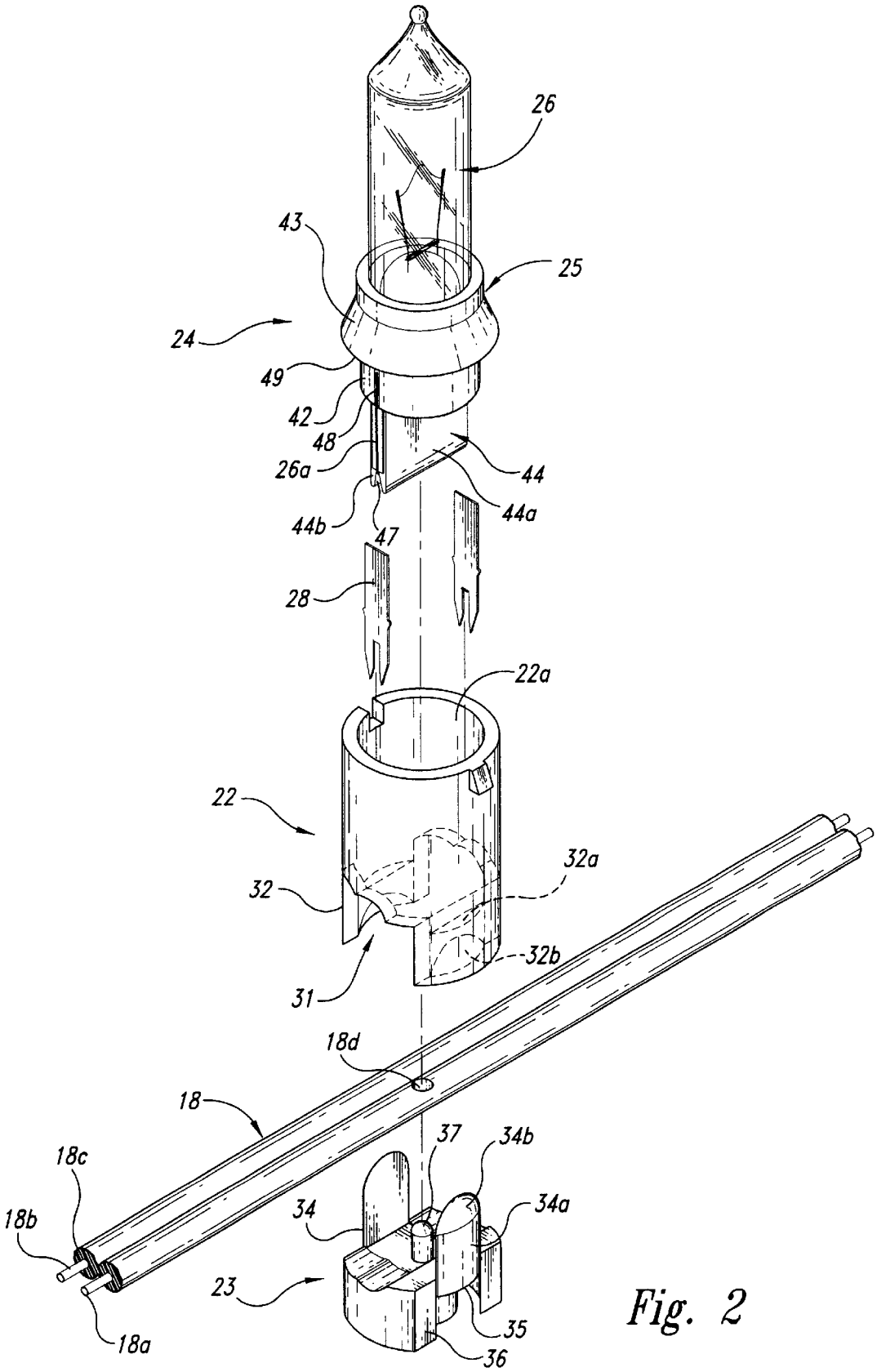
FIG. 2 is an exploded isometric view of a light assembly and a portion of a conductor wire from the embodiment of FIG. 1.

The light unit 16 of this particular embodiment is illustrated in FIG. 2. The inventor appreciates that other suitable light units could be used. The light units 16 can be of the push-in type shown, for example, in U.S. Pat. Nos. 4,631,650 and 4,779,177, and 5,154,508, but could have two rather than three wires in the cord 18, as illustrated. More specifically, the light units 16 may be, for example, of the type including an injection-molded two-piece plastic lampholder consisting of a socket unit 22 and a generally U-shaped base unit 23 which have a snap interfit and provide therebetween a wireway 31 for passage of the cord 18 containing an interrupted active wire 18*a* and a return wire 18*b*. The socket unit 22 provides a generally circular socket cavity 22*a* along the length for receiving a push-in bulb unit 24 having an injection-molded plastic bulb holder 25 in which a bulb 26 with a pair of leads 26*a* from its filaments is mounted. Each lampholder also has a pair of elongated push-in contact elements 28 located in guideways at opposite sides of the socket cavity 22*a* and arranged to project into the wireway 31. There the contact elements 28 pierce the insulation 18*c* of the cord 18 so as to engage the wire 18*a* of the cord on opposite sides of a respective cutout 18*d* in the wire.

Projecting from the socket unit 22 on opposite sides of the wireway 31 are two locking legs 32 presenting opposed locking shoulders 32*a* adjacent their outer end for interfitting with the base unit 23. These shoulders 32*a* are adjoined by beveled lead-in faces 32*b*. The inner face of each locking leg 32 is transversely concave matching the curvature of the socket cavity 22*a*.

The base unit 23 has a pair of flexible guide fingers 34 shaped to engage the lead-in faces 32*b* and be flexed at their root end toward one another responsive to pushing of the base unit 23 and socket housing 22 together from opposite sides of the cord 18 after the base unit 23 has been positioned with the cord 18 straddled by the guide fingers 34 at the site of the cutout 18*d*. At their root end the guide fingers 34 have retaining shoulders 35 between curved base flanges 36. These shoulders 35 are engaged by the locking shoulders 32*a* when the base unit 23 and socket unit 22 are snap-fitted together over the cord 18. As a result, the cord 18 is firmly gripped between the base unit 23 and socket unit 22. The guide fingers 34 are arched transversely to provide each with a convex outer guide face 34*a* complementing the concave inner guide face of the respective locking leg 32, and the free end of each guide finger 34 is rounded and beveled on its convex outer side as indicated at 34*b*. The base unit 23 presents a post 37 arranged between the guide fingers 34 to project into the cutout 18d in active wire 18*a* of the cord 18.

The bulb holder 25 has a central socket to receive the bulb 26. This socket is provided in a round plug 42 having an outwardly flared annular rim 43 spaced above its lower end, and having a relatively narrow extension 44 with opposite exterior flat side faces 44*a* between narrow pinch faces 44*b*. A pair of longitudinal passages (not shown) extend through the base of the plug 42 and through the length of the extension 44 into a slot 47 located at the free end of the narrow extension 44 and intersecting the narrow faces 44*b*. These narrow faces 44*b* are spaced apart slightly less than the diameter of the socket cavity 22*a* to allow for the bulb leads 26*a* and are aligned with the bottom of positioning grooves 48 which are formed in the plug 42 and extend to an annular shoulder 49 at the base of the flared rim 43. When the bulb 26 is positioned in the bulb holder 25, the lead wires 26*a* extend from the bulb 26 through the passages and outwardly at opposite ends of the slot 47. The leads 26*a* double back toward the bulb 26 over the narrow pinch faces 44*b* and part way into the grooves 48. When the bulb unit 24 is pushed into the socket unit 22 the bulb leads 26*a* are pinched between the pinch faces 44*b* and the contact elements 28 to complete a circuit bypassing the respective cutout 18*d* in the wire 18*a*.

In the alternative, the light units may be of the type commonly associated with "twisted wire" sets in which the terminal elements in the housing of each light unit are crimped onto the end portions of the interrupted hot wire and the return ground wire is twisted around the hot wire between the light units.

Figure 3:
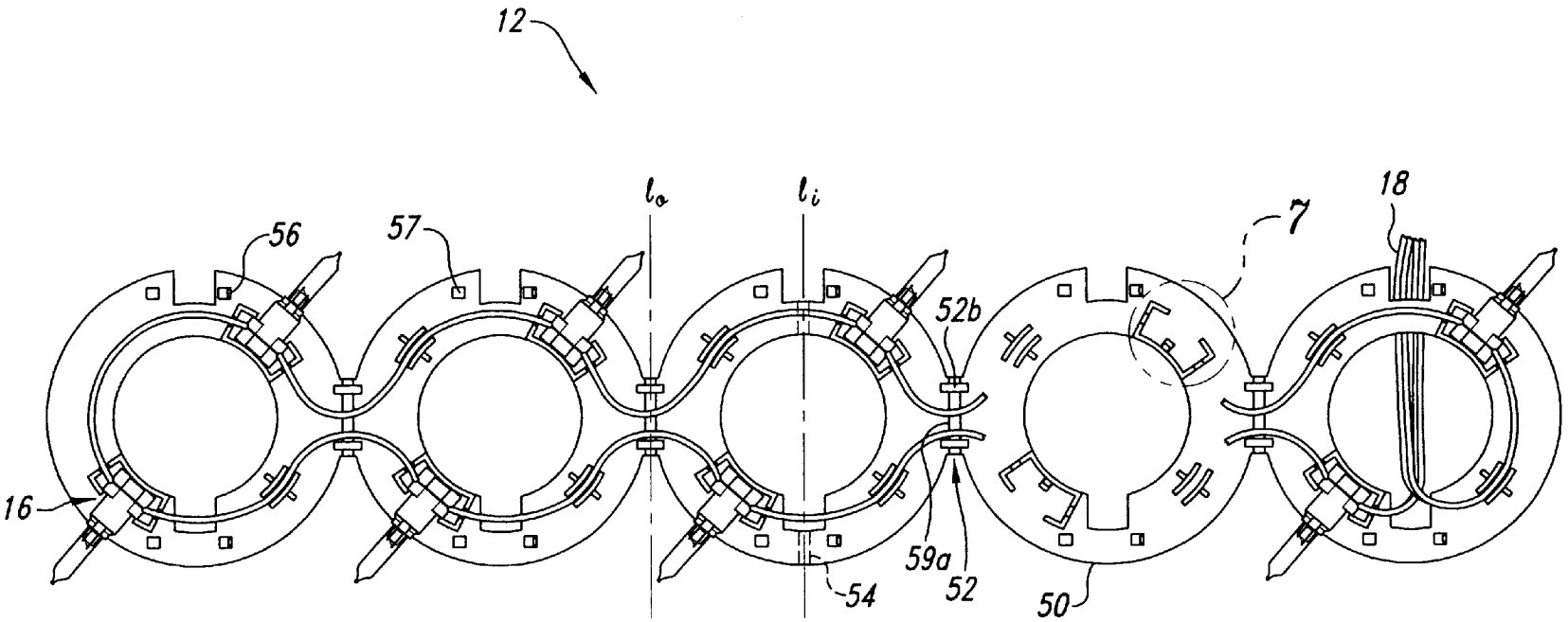
FIG. 3 is a plan view of an unassembled light fixture and string of lights according to the embodiment illustrated in FIG. 1.

As shown in FIG. 3, the frame 12 can be formed by aligned injection molded rings 50 connected together by integral plastic tangential hinges 52 having a reduced thickness along outer fold lines $l_o$ extending tangentially between adjoining rings. In the illustrated embodiment, each ring 50 in turn has a pair of integral diametrically opposite bisecting hinges 54 spaced ninety degrees along the ring from at least one of the tangential hinges 52. In this regard, the bisecting hinges 54 have a reduced thickness along inner fold lines $l_i$ formed by grooves 54*a* (FIG. 5) located on the opposite face of the rings from the tangential hinges 52. With this construction, the tangential hinges 52 bend along the outer fold lines $l_o$ in one direction to form the outer edge of the vanes 14 while the bisecting hinges 54 bend in an opposite direction along the inner fold lines $l_i$ to form the inner edges of the vanes. Each of the tangential hinges 52 may be interrupted by a pair of cutouts 52*b*.

Figure 4:
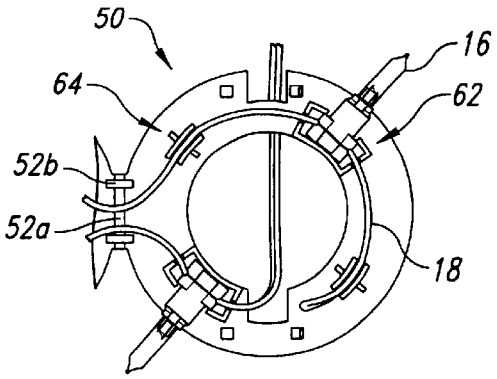
FIG. 4 is a plan view of a portion of the fixture and light string of FIG. 3.
Figure 7:
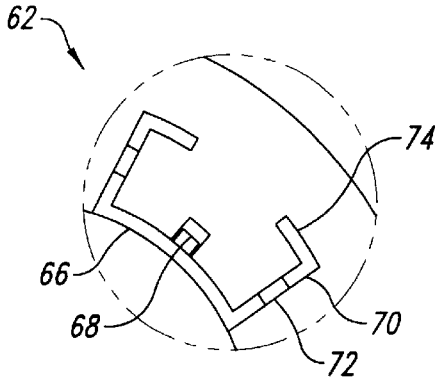
FIG. 7 is an enlarged plan view of the designated portion of FIG. 3.

The front face of the each ring 50, as illustrated in FIG. 4, has a pair of diametrically opposed light clips 62 and a pair of diametrically opposed wire clips 64. In the illustrated embodiment, the wire clips 64 are spaced 90 degrees around the ring 50 from the light clips 62. The inventor appreciates that the rings 50 can be configured with more or fewer light clips for holding a corresponding greater or lesser number of light units 16, and can have more or fewer wire clips 64 positioned to route the cord 18 in different directions. As best illustrated in FIG. 7, the light clips 62 have a bottom wall against which the base of a light unit 16 rests during use (FIG. 4). A retainer clip 98 can be positioned near the base wall 66 to retain the light unit 16 within the light clip 62. The light clip 62 has a pair of opposing sidewalls 70, each having an opening 72 through which the cord 18 extends during operation (FIG. 4). The openings 72 can be configured as edge openings along the sidewalls 70 to allow the cord 18 to be merely press-fit into the opening. The light clip 62 can have a pair of outerwalls 74 to help retain the light unit 16 in its proper configuration during use. The inventor appreciates that a wide variety of clips can be substituted for the illustrated clip without deviating from the spirit of the invention.

Figure 5:
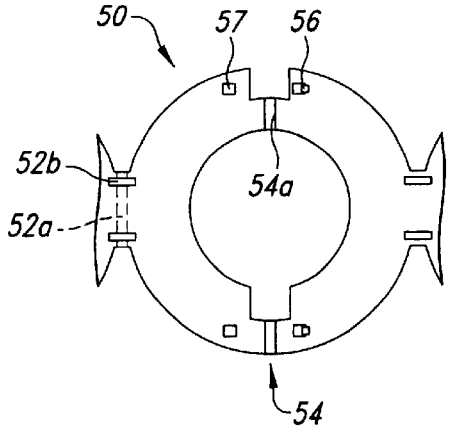
FIG. 5 is a bottom plan view of another portion of the fixture of FIG. 3.
Figure 6:
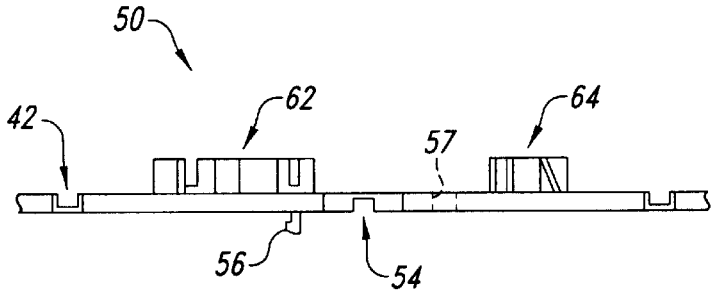
FIG. 6 is a top view of the portion of the fixture of FIG. 5.

When the frame is injection-molded, the rings 50 are in strip form with the grooves 52*a* forming the tangential hinges 52 on the front side as viewed in FIG. 3. The back side, illustrated in FIG. 5, is smooth except for the grooves 54*a* forming the bisecting hinges 54 and pairs of rearwardly projecting snap hooks 56 located on alternate halves of the rings 50 adjacent the bisecting hinges 54. Rectangular cutouts 57 in the adjoining half of the adjoining ring 50 complement the snap hooks 56 and are arranged so that when the bills of the snap hooks are forced through the cutouts, they lock against the front side of the rim of the respective cutout.

Figure 8:
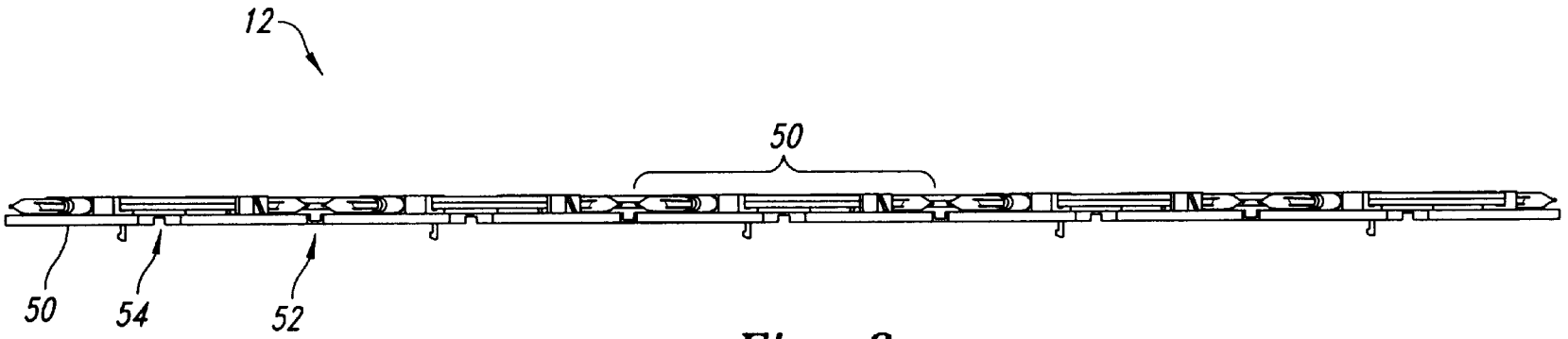
FIG. 8 is a bottom plan view of the fixture and light string of FIG. 3, shown in a first step of fabrication.

FIGS. 8–11 illustrate one embodiment of a method for fabricating a light fixture according to the present invention. In this particular embodiment, the frame 12 is similar to that described above and illustrated in FIG. 3. As illustrated in FIG. 8, the leftmost ring 50 does not have a tangential hinge 52 on its left edge, as it has no adjacent ring. The first hinge found from left to right is accordingly a bisecting hinge 54. Continuing left to right, the hinges alternate between tangential hinges 52 and bisecting hinges 54, with the final hinge being a bisecting hinge 54 for the same reason as that discussed immediately above.

Figure 9:
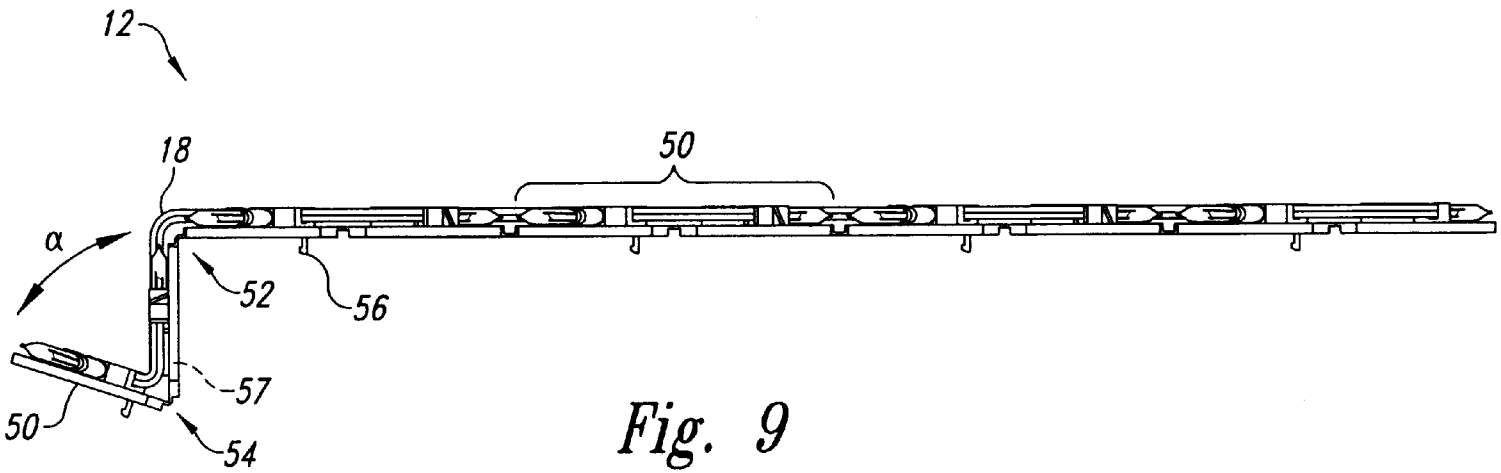
FIG. 9 is a bottom plan view of the fixture and light string of FIG. 8, shown in a second step of fabrication.

As illustrated in FIG. 9, the leftmost ring 50 has been bent concave upwardly about a bisecting hinge 54 to create a first dihedral angle a between a first pair of vanes. The leftmost ring 50 has been folded concave downward about a tangential hinge 52 with respect to the adjacent ring to its right.

Figure 10:
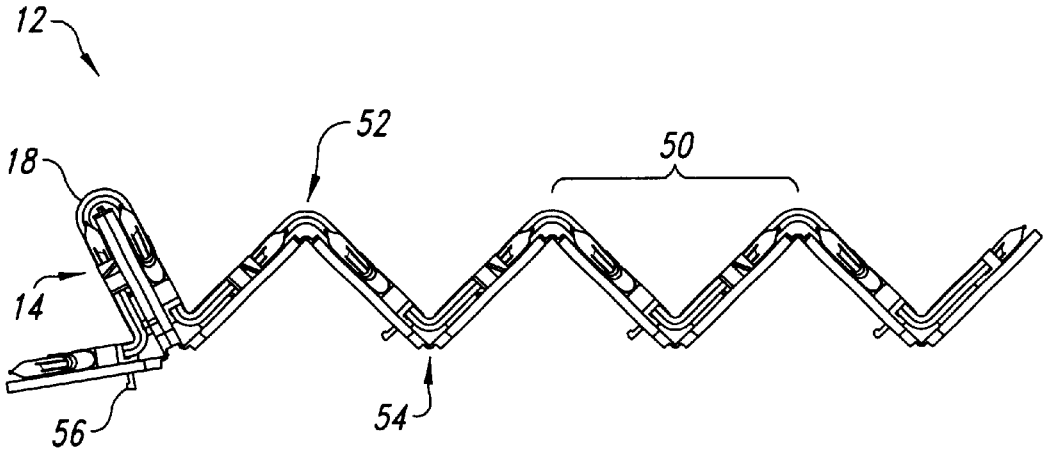
FIG. 10 is a bottom plan view of the fixture and light string of FIG. 8, shown in a third step of fabrication.

As illustrated in FIG. 10, the leftmost ring 50 has been folded beyond the point shown in FIG. 9 until it contacts the adjacent ring, creating a first vane 14. Likewise, each bisecting hinge 54 is bent to form a concave upward dihedral angle $\alpha$, and each tangential hinge 52 is bent concave downward to eventually form a vane. Ultimately, the leftmost half of the leftmost ring will mate with the rightmost half of the rightmost ring to form a final vane 14.

Figure 11:
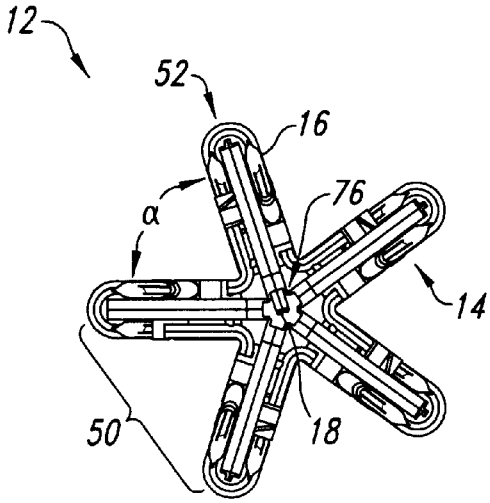
FIG. 11 is a bottom plan view of the fixture and light strong of FIG. 8, shown in a fourth step of fabrication.

As illustrated in FIG. 11, the frame 12 has been completely folded into its final configuration. In this configuration, the cord 18 can be extended upward through an opening 76 to allow the fixture to be suspended during use.

The invention discussed above has many advantages over the prior art. For example, the frame 12 can be injection-molded or otherwise manufactured in a flat form for ease and efficiency of packaging, delivery and/or storage. The frame 12 is also easy to fabricate, and can be configured for ease of assembly and disassembly each season. Likewise, the cord 18 carrying light units 16 can be easily installed and removed from the frame 12. Consequently, the system can be easily stored, and the light string can be used either with or without the frame.

Figure 12:
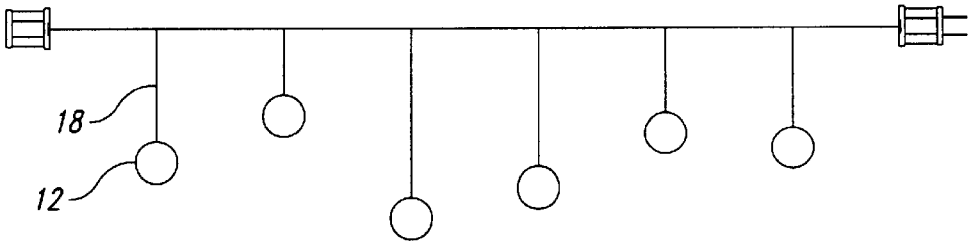
FIG. 12 is an elevation view schematically illustrating a series of fixtures according to one possible embodiment of the present invention.
Figure 13:
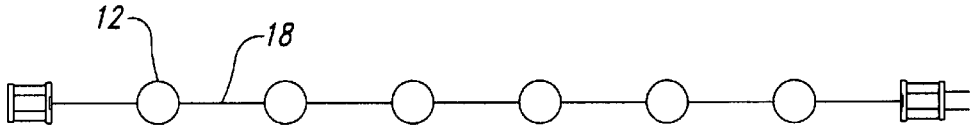
FIG. 13 is a bottom plan view of the series of fixtures of FIG. 12.

FIGS. 12 and 13 illustrate one possible configuration of a complete lighting system according to one embodiment of the present invention. In this particular embodiment, a number of frames 12 are suspended from a cord 18 at varying elevations. The cords 18 are configured to be attachable in series with other similar or different cords to form a portion of a greater lighting display. The inventor appreciates that the configuration of fixtures 12 can vary dramatically without deviating from the scope of the present invention.

The applicant appreciates that many modifications and variations can be made to the embodiments discussed above and illustrated herein without diverging from the spirit of the invention. For example, frames can be fabricated from a number of independent rings that are linked together at hinge members to fold according to the above-described method. Likewise, the frame can be manufactured from a number of half rings which are coupled to each other and to adjacent half rings by hinging members and folded according to the above-described method. As such, both the tangential hinges and the bisecting hinges can be integral or can be assembled. The illustrated embodiment is manufactured from injection-molded plastic, but the inventor appreciates that nearly any material would work. Further, the invention discloses one method of connecting portions of the frame to each other to form vanes. It is envisioned that many forms of adhesives, both temporary and permanent, can be substituted for the illustrated connectors. Other modifications and variations would be apparent to those of ordinary skill in the art. Accordingly, the scope of the invention should be interpreted only based on the claims below.

What is claimed is:

1. An ornament comprising:

at least one frame including:

a series of linked rings including two end rings and at least one intermediate ring positioned between the end rings, each of the rings having two central hinges positioned opposite each other across the ring to delineate two opposing lobes arranged to pivot at the hinges about a swing axis from a coplanar position toward one another in a first direction form an internal angle;

the adjacent lobes of each pair of linked rings being hinged by a tangential hinge configured to swing at a periphery of the respective rings toward one another about a tangential swing axis in a second direction opposite to the first direction from a coplanar position to an abutting position to form a vane from the lobes;

all of the swing axes being at least substantially parallel to one another and the central hinges being located between each pair of the tangential hinges so that the rings can be arranged in a ball-like configuration having a center axis with adjacent lobes projecting in pairs therefrom as vanes and with adjoining vanes being separated by the internal angles; and a string of lights mounted on the frame.

2. The ornament of claim 1 wherein the light string includes a light unit mounted on each lobe to occupy a position within the respective internal angle.

3. The ornament of claim 2 wherein the frame has integral mounting elements on each lobe for holding the light unit in position.

4. The ornament of claim 3 wherein the string of lights includes a cord extending between the light units and the frame has guide elements for guiding the cord.

5. The ornament of claim 1 wherein the frame is a one-piece injection molded plastic unit.

6. The ornament of claim 1 wherein the central hinges are integrally formed with the adjacent lobes of the rings.

7. The ornament of claim 1 wherein the tangential hinges are integrally formed with the adjacent rings.

8. The ornament of claim 1 wherein the series of linked rings comprises five rings.

9. The ornament of claim 1 wherein the central hinges bisect the lobes of each ring into two equal sized lobes.

10. The ornament of claim 1 wherein the internal angle is an acute angle.

11. The ornament of claim 1 wherein each of tho vanes has complementing snap hooks and cut outs on opposite sides of the respective tangential hinges for retaining the lobes in the abutting position and for holding the outer lobes of the end rings in and abutting position with each other.

12. A light set comprising:

a fixture having a plurality of vanes projecting radially outward from a central core, a pair of adjacent vanes being formed from an integral structure shaped such that a first portion of the integral structure forms at least a portion of one of the vanes and a second portion of the integral structure is angled with respect to the first portion to form at least a portion of an adjacent one of the vanes; and at least one light unit coupled to each vane, the light units being connected in series by an electrical conductor, the electrical conductor being coupleable to a source of electricity.

13. The light set of claim 12 wherein the vane structures have a semi-circular profile.

14. The light set of claim 12 wherein the fixture is bilaterally symmetric.

15. The light set of claim 12 wherein the vane structures are of a generally identical size and shape, such that the fixture is radially symmetric.

16. The light set of claim 12 wherein the vane structures have a semi-circular profile and are of a generally identical size such that the fixture has a generally spherical shape.

17. The light set of claim 12 wherein the fixture is formed from a single, integral unit, formed to create the plurality of vanes.

18. The light set of claim 12 wherein the fixture is formed from a single, integral structure having a length, the structure being bent in alternating directions along its length, and wherein pairs of bent sections of the structure being folded to form a vane.

19. The light set of claim 12, further comprising a plurality of fixtures electrically coupled to each other in series.

20. A method for fabricating a light fixture, comprising:

alternatingly bending a plurality of sections of an elongated carrier structure along a plurality of substantially parallel axes, the bends in a first direction being formed to create outwardly projecting vanes from the adjacent sections of the carrier structure, and the bends in an opposing second direction being formed to radially space apart the adjacent pair of vanes; and coupling a series of light units to the light fixture.

21. The method of claim 20 wherein bending the sections of the carrier structure in the first direction comprises bending the sections approximately 180 degrees to form a substantially flat vane.

22. The method of claim 20 wherein the axes are spaced apart from each other equally, and wherein altematingly bending the sections comprises alternatingly bending equal length sections to form a symmetrical light fixture.

23. The method of claim 20 wherein the axes are spaced apart from each other equally and the sections of the carrier structure are semi-circular, and wherein alternatingly bending the sections comprises alternatingly bending equal length, semi-circular sections to form a plurality of vanes defining a generally spherical light fixture.

24. The method of claim 20 wherein tile elongated carrier structure has hinge strictures aligned with the axes, and wherein altematingly bending the sections comprises bending the sections along the hinge structure.

25. The method of claim 20, further comprising coupling the light fixture to another light fixture.

26. The method of claim 20, further comprising coupling the light fixture to a plurality of other light fixtures.

* * * * *